US007540576B1

(12) United States Patent
Ross

(10) Patent No.: US 7,540,576 B1
(45) Date of Patent: Jun. 2, 2009

(54) DRAWER FRONTS

(75) Inventor: David T. Ross, Beach Park, IL (US)

(73) Assignee: Snap-on Incorporated, Kenosha, WI (US)

( * ) Notice: Subject to any disclaimer, the term of this patent is extended or adjusted under 35 U.S.C. 154(b) by 306 days.

(21) Appl. No.: 10/644,179

(22) Filed: Aug. 20, 2003

Related U.S. Application Data

(60) Provisional application No. 60/405,782, filed on Aug. 23, 2002.

(51) Int. Cl.
*A47B 88/00* (2006.01)

(52) U.S. Cl. ..... 312/348.4; 312/348.1

(58) Field of Classification Search ..... 312/348.4, 312/348.1, 348.2, 108, 257.1, 265.5, 263; 220/529, 534, 543–546, 552, 4.32, 4.28, 220/682; 217/12 R, 13, 43 R, 45, 65; 403/331, 403/381, 401, 402
See application file for complete search history.

(56) References Cited

U.S. PATENT DOCUMENTS 1,172,189 A * 2/1916 Bauer ..... 312/348.4
1,222,451 A * 4/1917 Ohnstrand ..... 312/348.4
2,335,391 A 11/1943 Cushing
2,758,748 A 8/1956 Knoefes
2,842,420 A * 7/1958 Hansen et al. ..... 312/348.6
3,000,685 A 9/1961 Gross
3,160,448 A * 12/1964 Abernathy et al. ..... 312/334.7
3,526,934 A * 9/1970 Owen, Sr. ..... 285/154.1
3,694,047 A 9/1972 Inhelder
3,730,605 A 5/1973 Eckard
4,036,542 A * 7/1977 Courtwright ..... 312/348.2
4,108,519 A 8/1978 Chervenak
4,153,314 A 5/1979 Prater
4,162,114 A 7/1979 Litchfield et al.
4,173,379 A * 11/1979 van der Heiden et al. 312/348.1
4,230,382 A 10/1980 Wenzlick et al.
4,273,395 A 6/1981 Martinez et al.
4,391,478 A 7/1983 Grunert
4,461,520 A 7/1984 Alneng (Continued)

FOREIGN PATENT DOCUMENTS

CH 658171 * 10/1986 ..... 312/348.1

(Continued)

OTHER PUBLICATIONS

Snap-on drawing of steel drawer front on sale since prior to 2002.

*Primary Examiner*—Hanh V Tran
(74) *Attorney, Agent, or Firm*—Seyfartth Shaw LLP

(57) ABSTRACT

A drawer panel includes an elongated wall, a projection on the wall having a first portion extending rearwardly from the rear side of the wall and a second portion extending along the rear side of the wall for cooperation therewith to define a channel therebetween, and a drawer pull at the front side of the wall. A drawer has mounting structure thereon including a base portion projecting forwardly therefrom and an attachment portion projecting from the base portion and extending above and/or below the base portion so as to be slidably received in the channel of the panel for mounting the panel in a mounted position extending across the front of the drawer without the use of fasteners or weldments.

12 Claims, 5 Drawing Sheets

U.S. PATENT DOCUMENTS

| | | | | | |
|---|---|---|---|---|---|
| 4,592,601 | A | | 6/1986 | Hlinsky et al. | |
| 4,595,245 | A | | 6/1986 | Röck et al. | |
| 4,667,822 | A | | 5/1987 | Coopmans | |
| 4,732,430 | A | | 3/1988 | Byrns | |
| 5,123,680 | A | | 6/1992 | Liu | |
| 5,161,870 | A | * | 11/1992 | Mason et al. | 312/348.4 |
| 5,165,771 | A | | 11/1992 | Ballman et al. | |
| 5,181,772 | A | | 1/1993 | Albiez | |
| 5,370,454 | A | * | 12/1994 | Domenig | 312/348.1 |
| 5,730,511 | A | * | 3/1998 | Doan et al. | 312/234.4 |
| D398,795 | S | | 9/1998 | Zapf | |
| 5,823,650 | A | * | 10/1998 | Lin | 312/348.1 |
| D402,143 | S | | 12/1998 | Zapf | |
| 5,951,133 | A | | 9/1999 | Dittberner et al. | |
| 5,983,420 | A | | 11/1999 | Tilley | |
| 6,309,039 | B1 | | 10/2001 | Park et al. | |

FOREIGN PATENT DOCUMENTS

| | | | | |
|---|---|---|---|---|
| DE | 7829862 | | 3/1979 | |
| DE | 8616300 | | 9/1986 | |
| DE | 201 02 359 | | 4/2001 | |
| EP | 0427570 | | 5/1991 | |
| EP | 11228719 | | 8/2002 | |
| GB | 2071995 | * | 9/1981 | 312/348.1 |
| GB | 2198927 | | 6/1988 | |
| GB | 2255000 | | 10/1992 | |
| TW | 200980 | | 2/1993 | |
| TW | 285315 | | 9/1996 | |

* cited by examiner

DRAWER FRONTS

RELATED APPLICATION

This application claims the benefit of the filing date of copending U.S. Provisional Application No. 60/405,782, filed Aug. 23, 2002.

BACKGROUND

This application relates to devices, such as cabinets, having drawers and has particular application to drawer fronts and handles or pulls for such drawers.

Drawers for cabinets and other devices, particularly metal drawers, often have a drawer front that is made from a steel stamping, which may be welded or otherwise permanently attached to the drawer body, such as by suitable fasteners. It is known to make such drawer fronts or portions thereof by extruding suitable metals, such as aluminum, but they are always fastened in place on the drawer body by suitable fasteners or welding. Such arrangements are relatively expensive and time-consuming to assemble because of the fastening steps involved. Additionally, the fabrication of the drawer front itself is complicated by the fact that, since the drawer fronts must be provided in specific different sizes to fit on different-width drawers, the tooling for making the drawer fronts tends to be expensive because of the need to provide mounting features on the drawer fronts at different locations to accept fasteners or the like for assembly. Furthermore, the additional manufacturing and assembly steps required add expense, as does the need to inventory a number of different parts, including fasteners.

SUMMARY

There are disclosed herein drawer fronts, drawers formed therewith and methods of assembling same which avoid the disadvantages of prior devices and techniques while affording additional structural and operating advantages.

In particular, there is provided an improved drawer and front panel construction which is characterized by ease and economy of fabrication and assembly.

More specifically, there is disclosed a drawer panel for the front end of a drawer, the panel comprising: an elongated wall having a front side and a rear side, a projection on the wall and having a base portion extending rearwardly from the rear side of the wall and an attachment portion integral with the base portion and extending therefrom along the rear side of the wall for cooperation with the rear side of the wall to define a channel therebetween, and a drawer pull at the front side of the wall.

There is also disclosed a drawer comprising a drawer body including a bottom wall and a peripheral wall structure extending upwardly from the bottom wall; a mounting structure on the peripheral wall structure and including a base portion projecting forwardly from the peripheral wall structure and an attachment portion projecting from the base portion and extending above and/or below the base portion; and a drawer panel of the type described above, wherein the attachment portion of the mounting structure is slidably receivable in the channel of the drawer panel for mounting the panel on the drawer body in a mounted condition extending across a front end of the drawer body.

There is also disclosed a method of making a drawer comprising: providing a drawer body with mounting structure including a base portion projecting forwardly from a front end of the drawer body and an attachment portion projecting from the base portion and extending above and/or below the base portion, providing a drawer panel including an elongated panel wall having a front side and a rear side and a projection extending from the rear side and cooperating therewith to define a channel therebetween, and slidingly inserting the attachment portion of the mounting structure in the channel of the drawer panel and sliding the panel therealong until the panel reaches a mounted position extending across the front end of the drawer body.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
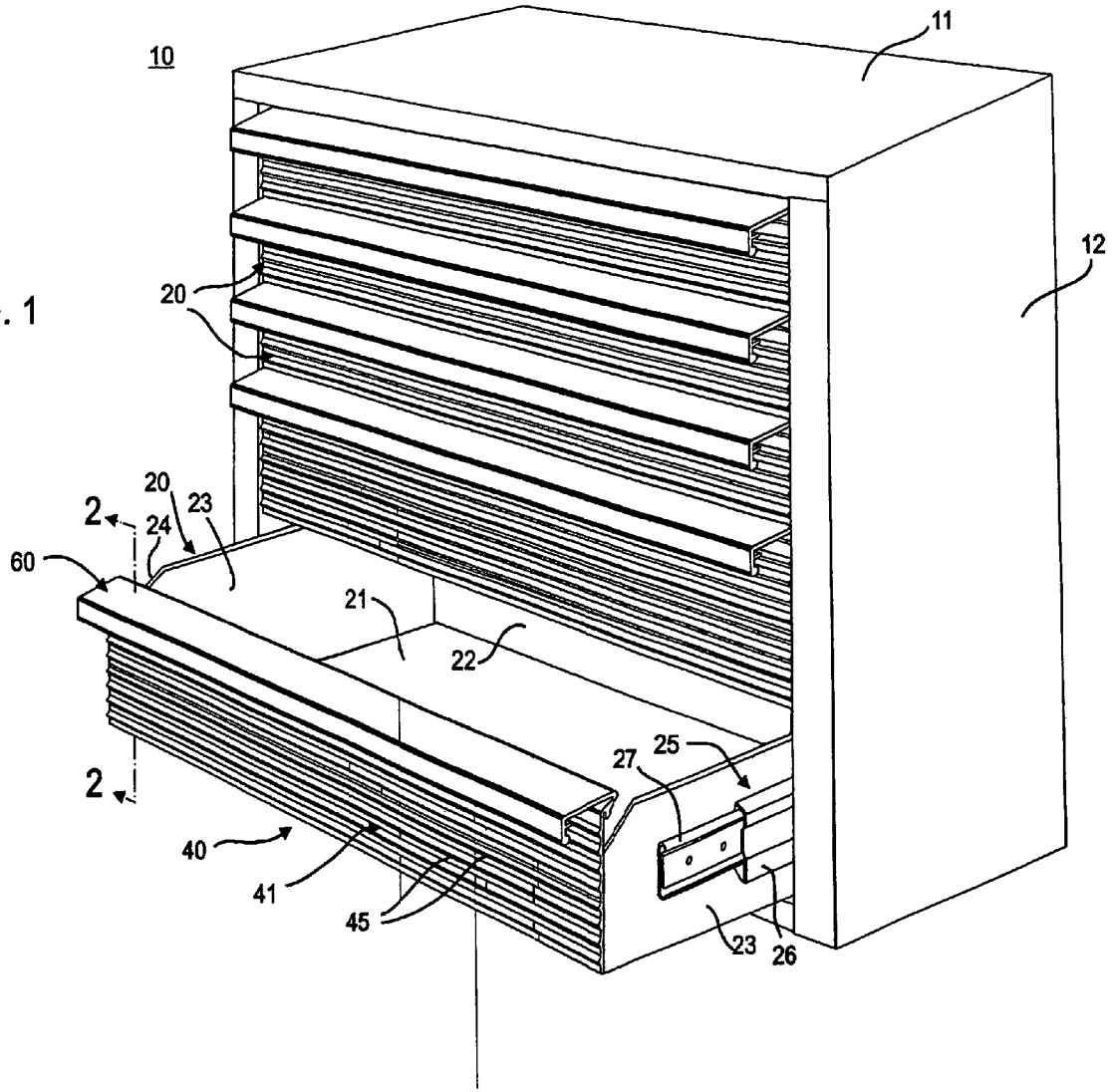
FIG. 1 is a perspective view of a cabinet with drawers having a unique drawer front construction.

Referring to FIG. 1, there is illustrated a cabinet, generally designated by the numeral 10, which may be in the nature of a tool cabinet, and includes a top wall 11, opposed side walls 12 (one shown), a rear wall (not shown) and a bottom wall (not shown). The cabinet 10 has an open front in which are mounted a plurality of drawers 20, which may be of varying depths, but are otherwise substantially identical in construction, one of the drawers being illustrated in a partially-open condition. The drawer 20 has an open-front drawer body including a bottom wall 21, a rear wall 22 and a pair of opposed side walls 23, each side wall having a front edge which is tapered or inclined at its upper end, as at 24. The side walls 23 of the drawer 20 may be mounted to the cabinet 10 by a pair of drawer slide assemblies 25 (one shown) which may be of known construction, each such assembly including a cabinet rail (not shown) fixed to the associated cabinet side wall 12, an intermediate rail 26 and a drawer rail 27 fixed to the drawer side wall 23, all in a known manner.

Figure 2:
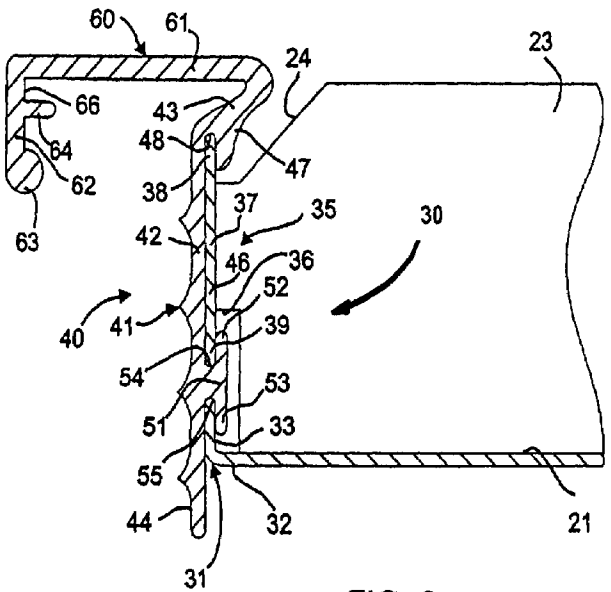
FIG. 2 is an enlarged, fragmentary, sectional view of one of the drawers of the cabinet of FIG. 1, taken generally along the line 2-2 in FIG. 1.
Figure 3:
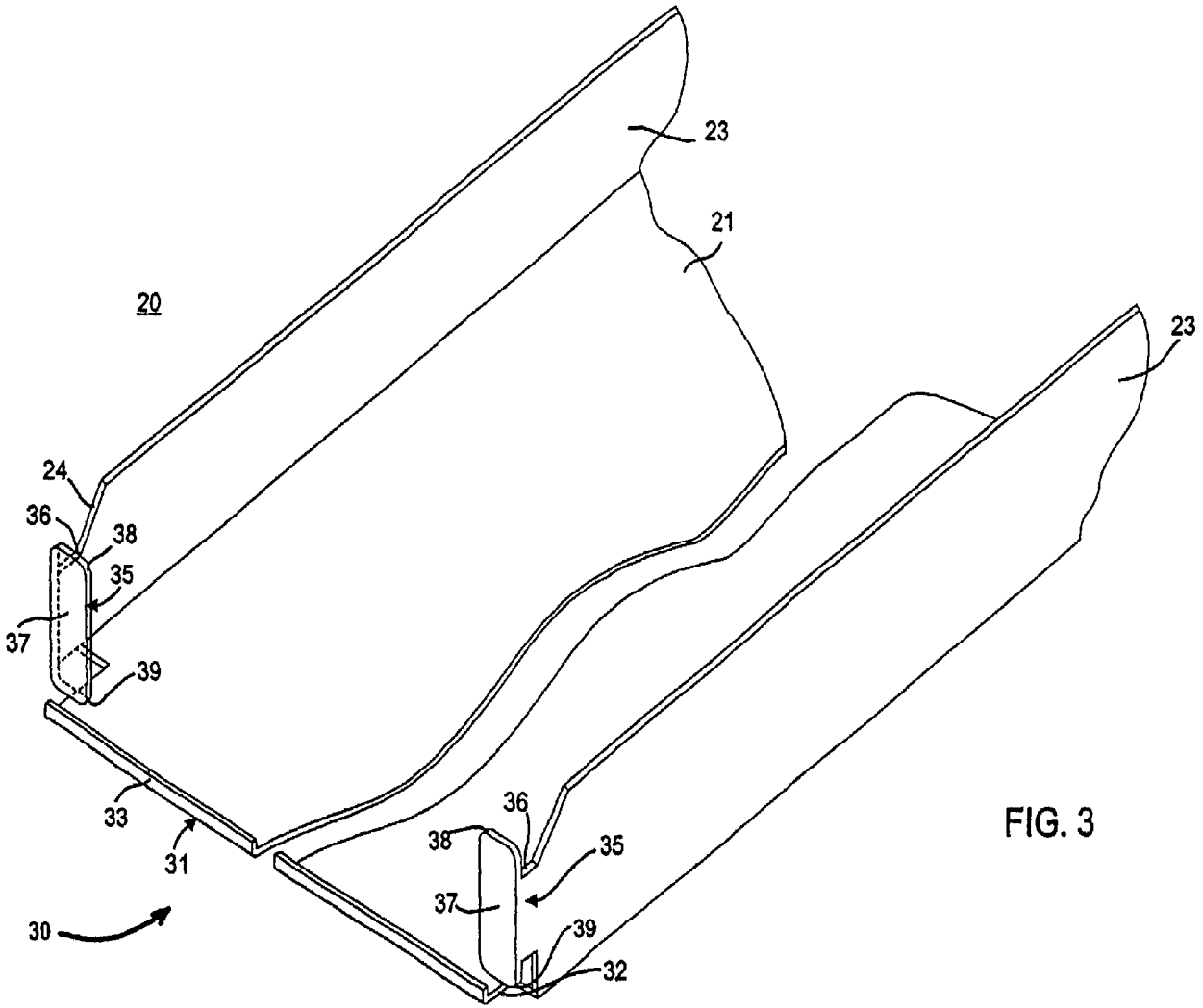
FIG. 3 is a fragmentary front perspective view of the drawer body of the drawer of FIG. 2.

Referring now also to FIGS. 2 and 3, the drawer 20 is provided at its front end with a mounting structure 30, which includes a lower mounting flange 31 having a base portion 32 which is substantially a forward extension of the drawer bottom wall 21, but narrower than the bottom wall 21, the base portion 32 being integral at its forward end with an upturned flange forming an attachment portion 33. The mounting structure 30 also includes a pair of upper mounting flanges 35, respectively provided at the forward ends of the drawer side walls 23, the mounting flanges 35 being substantially mirror images of each other, so that only one will be described in detail. The mounting flange 35 has a base portion 36 which is substantially a forward extension of the front edge of the drawer side wall 23, but of a substantially smaller vertical height, the base portion 36 being integral at its forward end with a laterally inwardly extending flange forming an attachment portion 37, which extends upwardly and downwardly beyond the ends of the base portion 36 to form upper and lower arms 38 and 39. As can be seen in FIG. 2, the attachment portion 33 of the lower mounting flange 31 is substantially coplanar with the attachment portions 37 of the upper mounting flanges 35.

Figure 4:
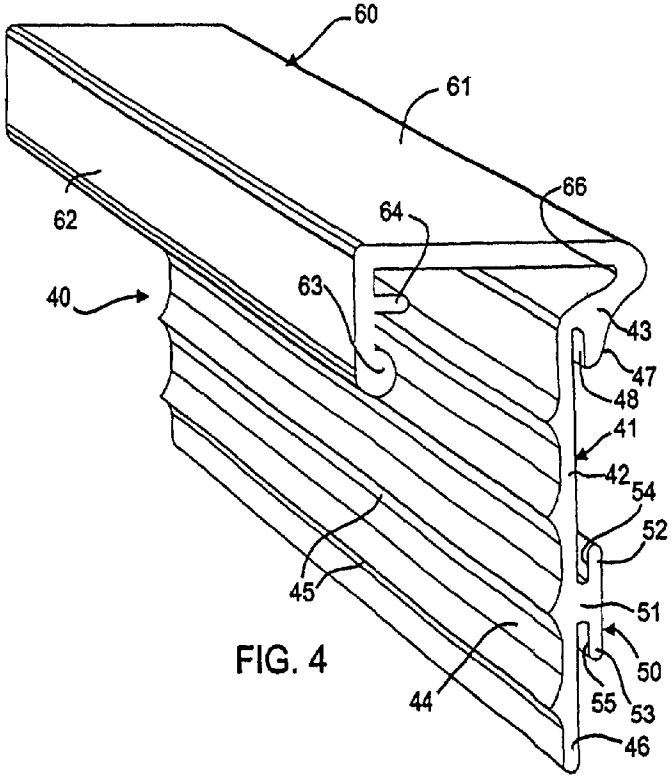
FIG. 4 is a further enlarged, fragmentary, perspective view of the drawer front of the drawer of FIG. 2.

Referring now also to FIG. 4, the drawer 20 is provided at its front end with a drawer front 40, which may be of unitary, one-piece construction. The drawer front 40 may be formed of a suitable metal, such a aluminum, and may be formed by extrusion. The drawer front 40 has a panel 41 which is substantially rectangular in shape and has a height at least that of the drawer side walls 23, including a vertical wall portion 42 integral at its upper end with a rearwardly sloping wall portion 43. The panel 41 has a front surface 44 which may be provided with decorative treatments, such as scalloping 45, and a rear surface 46. Integral with the sloping wall portion 43 of the panel 41 and projecting downwardly therefrom is an upper projection 47, which extends downwardly substantially parallel to the rear surface 46 of the vertical wall portion 42, spaced slightly rearwardly therefrom for cooperation therewith to define a channel 48. Projecting rearwardly from the rear surface 46 of the panel 41 intermediate its ends is a lower projection 50, which may be generally T-shaped in transverse cross section. More specifically, the lower projection 50 includes a rearwardly projecting stem 51 integral at its rear end with a vertical portion which extends upwardly and downwardly from the stem 51 to define an upper arm 52 and a lower arm 53. The arms 52 and 53 are substantially parallel to the rear surface 46 of the panel 41 for cooperation therewith to respectively define channels 54 and 55. It will be appreciated that each of the upper projection 47 and the lower projection 50 extends the entire width of the panel 41.

Also extending the width of the panel 41 is a drawer pull 60, which includes a rectangular top flange 61 integral with the sloping wall portion 43 of the panel 41 at its upper edge and projecting forwardly therefrom. The top flange 61 is integral at its forward end with a depending front flange 62, provided at its lower end with an enlarged bead 63 substantially part-circular in transverse cross. Projecting rearwardly from the front flange 62 intermediate its upper and lower ends is a rearward flange 64, which is spaced a slight distance below the top flange 61 for cooperation therewith to define the front end of the channel 66, the rear end of which is defined by the top flange 61 and the sloping wall portion 43 of the panel 41. It will be appreciated that the pull 60 defines a gripping portion beneath which a user's fingers may be fitted for operating the drawer 20 between its open and closed positions, all in a known manner. The channel 66 may be utilized for slidably receiving a drawer latching mechanism, such as that disclosed in U.S. Pat. No. 5,403,139.

It is a significant aspect of the drawer 20 that the drawer front 40 may be mounted on the body of the drawer without the use of any fasteners and without the need for weldments. More specifically, in assembly, the drawer front 40 is placed at one side of the body of the drawer 20 with the ends of the channels 48, 54 and 55 respectively aligned with the adjacent ends of the upper and lower arms 38 and 39 and attachment portion 33 of the drawer mounting structure 30. Those portions of the mounting structure 30 are then inserted in the respective channels and the drawer front 40 is slid along the mounting structure 30 across the front of the drawer to a position then being slide further, wherein the mounting structure 30 on the other drawer side wall 23 is received in the channels, until the drawer front 40 reaches the mounted position illustrated in FIG. 1, closing the front of the drawer 20. Preferably, the parts are dimensioned so that the parts will fit closely together so that there is negligible "play," while still permitting relative sliding movement without undue effort. If desired, for example if the frictional fit between the parts is not deemed sufficient, the drawer front 40 may be crimped to the mounting structure 30 to more firmly retain the parts in their assembled condition. For example, the opposite end edges of the drawer front panel 41 could be peened over or upset slightly rearwardly to prevent relative lateral movement of the parts or, alternatively, parts could be clamped together by application of a front-to-back clamping force at appropriate locations. There results a drawer having a drawer front which permits all the advantages of extruded aluminum construction, including the use of design and decorative features that are difficult or impossible to reproduce with steel stampings, while at the same time affording great ease and economy of assembly.

Figure 5:
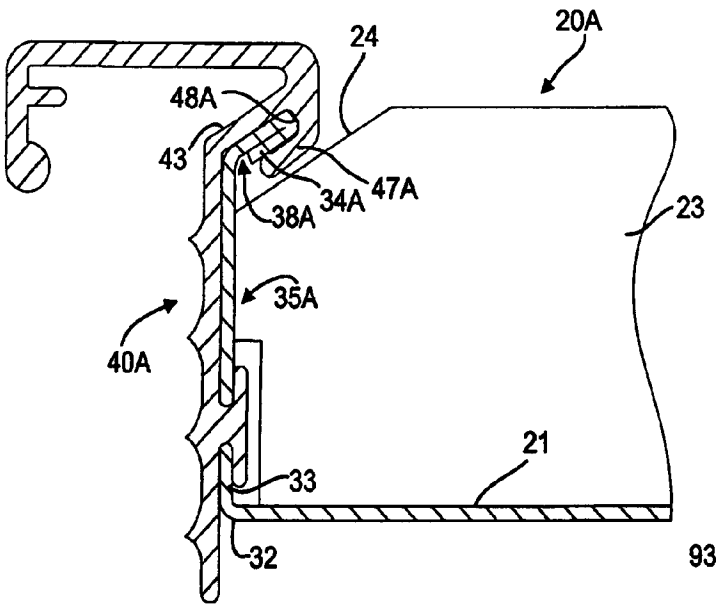
FIG. 5 is a view similar to FIG. 2 of a modified form of drawer construction.

Referring to FIG. 5, there is illustrated a drawer 20A which is substantially the same as the drawer 20, described above, so that all like parts bear the same reference numbers. However, in the drawer 20A, the mounting structure includes upper mounting flanges 35A (one shown) which have upper arms 38A which slope rearwardly and are provided with folded-under distal end portions 34A to provide a double-thickness upper arm. The drawer 20A is provided with a modified drawer front 40A which is substantially the same as the drawer front 40, described above, except that it is provided with an upper projection 47A which extends from the upper end of the sloping wall portion 43 and downwardly parallel to the rear surface thereof for cooperation therewith the define a channel 48A dimensioned to slidably receive the upper arm 38A of the upper mounting flange 35A. Assembly and operation of the drawer 20 are substantially the same as was described above for the drawer 20. However, the drawer 20A affords a slightly more robust construction, which affords increased resistance to any bending or deformation of the upper arm 30A as a result of forces exerted on the drawer pull in use.

Figure 6:
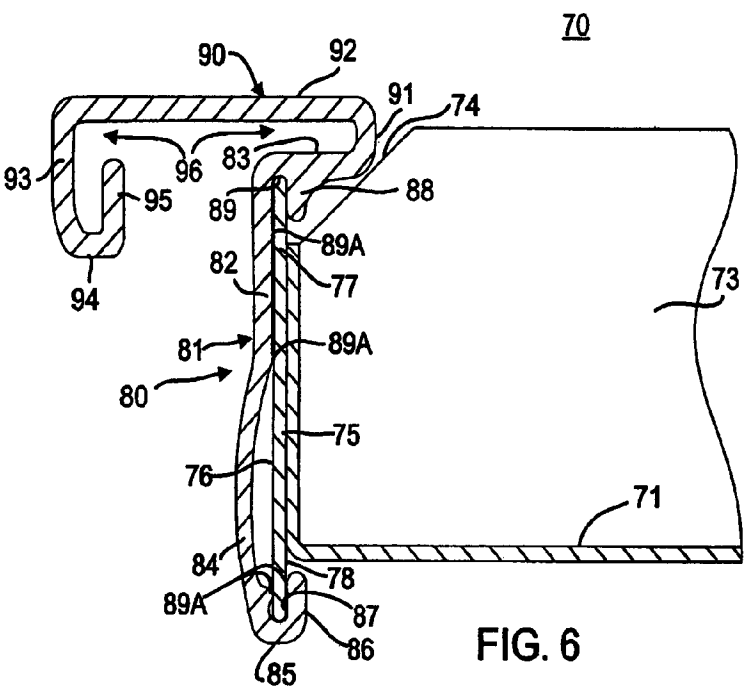
FIG. 6 is a view similar to FIG. 2 of yet another embodiment of drawer construction.

While the aforementioned embodiments utilize drawer fronts which not only provide a drawer pull but also form the front wall of the associated drawer, it will be appreciated that the techniques described above could also be utilized for mounting drawer fronts on drawers which already have front walls. Thus, referring to FIG. 6, there is illustrated a drawer 70 having a bottom wall 71 and opposed side walls 73 (one shown) with rearwardly sloping front upper edges, as at 74, and wherein the bottom wall 71 is upturned at its forward end to define a front wall 75 closing the front of the drawer. Fixedly secured to the front surface of the front wall 75 by any suitable means is a rectangular mounting panel 76 which extends at least the width of the front wall 75 and predetermined distances thereabove and therebelow to define attachment portions in the form of upper and lower arms 77 and 78, respectively. While the mounting panel 76 is illustrated as a separate part, it will be appreciated that it could also be formed unitary with the front wall 75.

The drawer 70 is provided with a drawer front 80 of unitary, one-piece construction and which may be generally similar to the drawer front 40, described above. The drawer front 80 has a generally rectangular panel 81 including a vertical portion 82, a rearwardly projecting portion 83 at the upper end thereof and a convex lower portion 84 depending from the vertical portion 82. Integral with the convex portion 84 at its lower end is a rearwardly projecting portion 85, which is integral at its rear end with an upturned flange forming a lower projection 86 which cooperates with the lower end of the convex portion 84 to define therebetween a channel 87. Depending from the rearwardly extending portion 83 of the panel 81 is an upper projection 88 which extends substantially parallel to the vertical portion 82 of the panel 81 for cooperation therewith to define therebetween a channel 89. The drawer front 80 is provided with a drawer pull 90 including an upwardly extending curved rear flange 91, which is integral with the rearwardly projecting portion 83 of the panel 81 at its rear end. A rectangular top flange 92 projects forwardly from the rear flange 91 and is integral at its front end with a depending front flange 93, which is in turn integral at its lower end with a rearwardly extending bottom flange 94, integral at its rear end with an upstanding lip or flange 95. The upper end of the lip 95 cooperates with the top flange 92 to define therebetween the front end of a channel 96, the rear end of which is defined by the top flange 92 and the rearwardly projecting portion 83 of the panel 81.

The assembly of the drawer 70 is substantially the same as was described above for the drawer 20, the upper and lower arms 77 and 78 of the mounting panel 76 being respectively slidably received in the channels 89 and 87. If desired, small beads or bosses 89*a* may be provided on the rear surface of the panel 81 and on forwardly facing surfaces of the upper and lower projections 88 and 86 for cooperation to define the desired channel width to afford the proper "play"-free fit of the arms 77 and 78 in the channels. In this arrangement, the front and rear surfaces of the arms 77 and 78 will bear only against the beads 89*a*, greatly reducing the area of surface contact and, accordingly, greatly reducing the friction between the parts during assembly.

Figure 7:
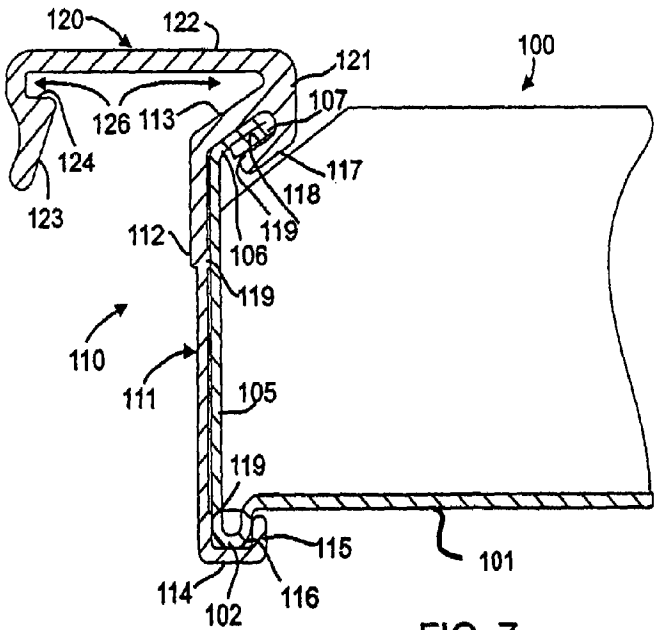
FIG. 7 is a view similar to FIG. 6 of yet another embodiment of drawer construction.

Referring now to FIG. 7, there is illustrated another embodiment of drawer 100 with a closed front end. The drawer 100 has a bottom wall 101 which, at its forward end may be bent to form a substantially U-shaped channel 102, which continues upwardly to define a vertical front wall 105 integral at its upper end with an upwardly and rearwardly sloping flange 106 having a folded-under distal end portion 107 to form a double-thickness flange. The drawer 100 is provided with a drawer front 110 including a panel 111 having a vertical wall portion 112 integral at its upper end with an upwardly and rearwardly sloping wall portion 113. The panel 111 is also integral at its lower end with a rearwardly extending flange 114, which is integral at its rear end with an upturned short flange or lip 115 which forms a lower projection cooperating with the panel 111 to define a channel 116 therebetween. Depending from the sloping wall portion 113 at its upper end is an upper projection 117, which extends downwardly and forwardly generally parallel to the sloping wall portion 113 for cooperation therewith to define a channel 118. Beads or bosses 119 may be formed on the rear surface of the panel 111 or on the front surfaces of the projections 115 and 117 to serve the same function as the beads 89*a*, described above.

The drawer front 110 includes a drawer pull 120 having a rear flange 121 which extends upwardly from the upper end of the sloping wall portion 113 of the panel 111, being integral at its upper end with a forwardly projecting, rectangular top flange 122. The top flange 122 is integral at its forward end with a depending front flange 123 having a thickened portion defining a shelf 124, which is spaced a predetermined distance below the top flange 122 for cooperation therewith to define the front end of a channel 126, the rear end of which is defined by the top flange 122 and the sloping wall portion 113 of the panel 111.

The assembly and operation of the drawer 100 is substantially similar to that of the drawer 70, described above, with the channel 102 and the sloping flange 106 being respectively slidably received in the channels 116 and 118 of the drawer front 110. The rearwardly sloping double-thickness flange 106 affords the same advantages as the double-thickness upper arm 38A, described above in connection with FIG. 5.

Figure 8:
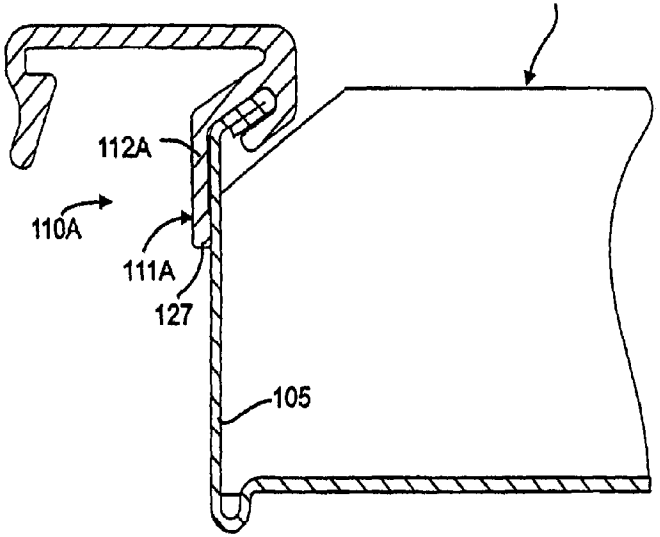
FIG. 8 is a view similar to FIG. 7 of a drawer with a modified drawer front.

Referring now also to FIG. 8, there is illustrated a drawer 100A which is substantially identical to the drawer 100, except that it utilizes a modified drawer front 110A. The drawer front 110A is substantially the same as the drawer front 110, except that it includes a panel 111 which is truncated, having a vertical wall portion 112 which terminates at a lower distal end 127, so that the panel 111A covers only the upper portion of the drawer front wall 105.

In the above-described embodiments, the drawer fronts 40, 40A, 80, 110 and 110A may be formed of extruded aluminum. The remainders of the drawers described above may be formed of suitable metals, such as suitable steels. However, it will be appreciated that, if desired, other materials, such as suitable plastics, could be utilized.

From the foregoing, it can be seen that there has been provided an improved drawer construction and, in particular, improved drawer front constructions and techniques for assembling them with drawer bodies, characterized by ease and economy.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicant's contribution. The actual scope of the protection sought is intended to be defined in the following claims when viewed in their proper perspective based on the prior art.

What is claimed is:

1. A drawer comprising:

a drawer body including a bottom wall and a peripheral wall structure fixedly connected to and extending upwardly from the bottom wall, the bottom wall and the peripheral wall structure defining a drawer space, the peripheral wall having first and second end portions;

first and second mounting structures on the respective end portions of the peripheral wall structure, each mounting structure including a base portion projecting forwardly from the peripheral wall structure and an attachment portion projecting from the base portion, the respective attachment portions projecting laterally inwardly from the respective base portion toward the drawer space; and a front panel including an elongated panel wall having a front surface and a rear surface, a projection on the panel wall having a base portion extending rearwardly from the rear surface of the panel wall and an attachment portion integral with the base portion and extending therefrom substantially parallel to the rear surface of the panel wall for cooperation with the rear surface of the panel wall to define a substantially continuous and open-ended channel therebetween that extends substantially the entire length of the panel wall, the attachment portions of the mounting structures being laterally slidably received in the channel of the front panel for mounting the front panel on the drawer body in a mounted condition extending across a front end of the drawer body.

2. The drawer of claim 1, wherein the attachment portions of the mounting structures are frictionally retained in the channel.

3. The drawer of claim 2, wherein the front panel is crimped to the mounting structures.

4. The drawer of claim 1, wherein the projection is a first projection, the front panel further including a second projection on the panel wall including portions cooperating with the rear surface of the panel wall to define a second channel therebetween.

5. The drawer of claim 4, wherein at least one of the first and second projections includes portions cooperating with the rear surface of the panel wall for forming two channels therebetween respectively opening in opposite directions.

6. The drawer of claim 1, wherein at least one of the attachment portions of the mounting structure includes a folded under portion.

7. The drawer of claim 1, wherein the drawer body has an open front, the front panel closing the open front of the drawer body.

8. The drawer of claim 1, wherein the peripheral wall structure includes two side walls, the end portions one each of the side walls and the base portions of the mounting structures projecting from respective side walls.

9. The drawer of claim 5 wherein each of the mounting structures has first and second flange portions, the flange portions received in the respective channels.

10. A method of making a drawer comprising:

providing a drawer body with a drawer space and first and second mounting structures, each mounting structure including a base portion projecting forwardly from a front end of the drawer body and an attachment portion projecting from the base portion toward the drawer space, providing a drawer panel including an elongated panel wall having a front surface and a rear surface and a projection extending from the rear surface and having a portion extending substantially parallel to the rear surface and cooperating therewith to define a substantially continuous and open-ended channel therebetween that extends substantially the entire length of the panel, aligning the attachment portion of the first mounting structure with the channel of the drawer panel, slidingly inserting the attachment portion of the first mounting structure in the channel of the drawer panel along a lateral direction;

advancing the drawer panel towards the second mounting structure;

slidingly inserting the attachment portion of the second mounting structure in the channel;

and sliding the panel therealong until the panel reaches a mounted position extending across the front end of the drawer body.

11. The method of claim 10, and further comprising crimping the panel to the mounting structure when the panel has been moved to its mounted position.

12. A drawer comprising:

a drawer body including a bottom wall and a peripheral wall structure fixedly connected to and extending upwardly from the bottom wall defining a drawer space;

a mounting structure on the peripheral wall structure including a base portion projecting forwardly from the peripheral wall structure and an attachment portion projecting from the base portion toward the drawer space; and a front panel including an elongated panel wall having a front surface and a rear surface, a projection on the panel wall having a base portion extending rearwardly from the rear surface of the panel wall and an attachment portion integral with the base portion and extending therefrom substantially parallel to the rear surface of the panel wall for cooperation with the rear surface of the panel wall to define a substantially continuous and open-ended channel therebetween extending substantially the entire length of the panel, the attachment portion of the mounting structure including a folded under portion and being laterally slidably received in the channel of the front panel for mounting the front panel on the drawer body in a mounted condition extending across a front end of the drawer body, the folded under portion overlying and contacting another portion of the attachment portion of the mounting structure.

* * * * *